US005833487A

United States Patent [19]

Joly

[11] Patent Number: 5,833,487

[45] **Date of Patent: *Nov. 10, 1998**

[54] IDC CONNECTOR

[75] Inventor: Jean Claude Joly, Osny, France

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 825,258

[22] Filed: Mar. 27, 1997

Related U.S. Application Data

[63] Continuation of Ser. No. 503,464, Jul. 18, 1995, abandoned.

[30] Foreign Application Priority Data

Aug. 24, 1994 [FR] France ..... 94 10257

[51] Int. Cl.[6] ..... H01R 4/24

[52] U.S. Cl. ..... 439/404

[58] Field of Search ..... 439/395–404, 439/410, 411, 417–419, 456, 457, 459

[56] References Cited

U.S. PATENT DOCUMENTS

| | | | |
|---|---|---|---|
| 4,114,975 | 9/1978 | Weidler | 339/176 M |
| 4,344,664 | 8/1982 | Walkup | 339/99 R |
| 5,277,616 | 1/1994 | Harting et al. | 439/417 |
| 5,295,857 | 3/1994 | Joly | 439/417 |
| 5,564,950 | 10/1996 | Loman et al. | 439/417 |

FOREIGN PATENT DOCUMENTS

| | | |
|---|---|---|
| 0 532 413 A1 | 3/1993 | European Pat. Off. . |
| 0 540 008 A1 | 5/1993 | European Pat. Off. . |
| 0 554 810-A2 | 8/1993 | European Pat. Off. . |
| 42 03 455 C1 | 6/1993 | Germany . |
| 2 093 280 | 8/1992 | United Kingdom . |
| 92 22941 | 12/1992 | WIPO . |

*Primary Examiner*—Gary F. Paumen
*Assistant Examiner*—Tho Dac Ta
*Attorney, Agent, or Firm*—Driscoll A. Nina

[57] ABSTRACT

An electrical connector comprises a housing and IDC terminals having IDC contact sections. The IDC contact section comprises a large wire receiving slot extending into a narrower IDC slot for connection to conducting strands of a insulated conducting wire. The wires are inserted longitudinally into wire receiving cavities extending from a rear face of the connector, whereby the cavities are bent such that they traverse obliquely the terminals, thereby causing the wire to pass through the wire receiving slot of the terminal, aligned with the cavity. The wire is inserted until it abuts a stop and, the terminal can then be further inserted into the housing such that the wire is stuffed into the IDC slot for connection therewith. This design advantageously benefits from IDC technology whilst also providing a very compact wire-to-wire spacing. Additionally, the housing and terminals are relatively simple and cost-effective to manufacture.

22 Claims, 4 Drawing Sheets

IDC CONNECTOR

This application is a Continuation of application Ser. No. 08/503,464 filed Jul. 18, 1995, now abandoned.

BACKGROUND OF THE INVENTION

1. Field of the Invention

This invention relates to an electrical connector for insulation displacement contact (IDC) with insulated conducting wire, and particularly for wires inserted longitudinally into the connector to provide a small wire-to-wire spacing.

2. Description of the Prior Art

It is common to find the use of insulation displacement contact (IDC) technology in the electrical connector industry, because it allows rapid and simple connection of conducting wires to terminals without stripping nor crimping, the latter requiring considerable force. A typical IDC connection is made by disposing an insulted conducting wire perpendicularly to a planar wall portion comprising an IDC slot, stuffing the wire into the slots such that edges thereof cut through the insulation and make electrical contact with conducting strands of the wire. The IDC slots are formed by opposed edges of a sheet metal wall portion which is necessarily of a certain width to have sufficient strength to support the contact pressure against the edges. The width of the IDC wall and an additional insulating wall of a housing cavity receiving the terminal, determines the adjacent wire-to-wire minimum distance. For certain applications, it would be desirable to have a very compact connector whereby the wire-to-wire spacing is as small as possible and yet have the benefits of IDC technology. A compact connector with IDC is shown in European Patent 554 810, where wires are longitudinally mounted in a first housing and stuffed into IDC contacts mounted in a second housing. The disadvantage of this design is that the wires cannot be individually mounted or exchanged, and two housings are required increasing the production and handling costs.

SUMMARY OF THE INVENTION

It is therefore an object of this invention, to provide an electrical connector with individually connectable IDC connections and a small wire-to-wire spacing.

It is a further object of this invention, to provide a cost-effective, compact and reliable connector using IDC technology.

The objects of this invention have been achieved by providing a connector having an insulative housing and one or more terminals having insulation displacement contact (IDC) sections for connection to longitudinally disposed insulated conducting wires, the terminals received in cavities of the housing, the terminals extending longitudinally between a rear face and an opposed front face of the connector wherein the housing has bent wire receiving cavities extending from the rear face and intersecting the terminal receiving cavities, whereby the terminals have wire receiving slots contiguous the IDC slots for receiving the wire therethrough when the terminals are in a wire receiving position and the wires are inserted into the wire receiving cavities, the terminals being longitudinally insertable towards the front face for stuffing the wires into the IDC slot.

DETAILED DESCRIPTION OF THE PREFERRED EMBODIMENT

Figure 1:
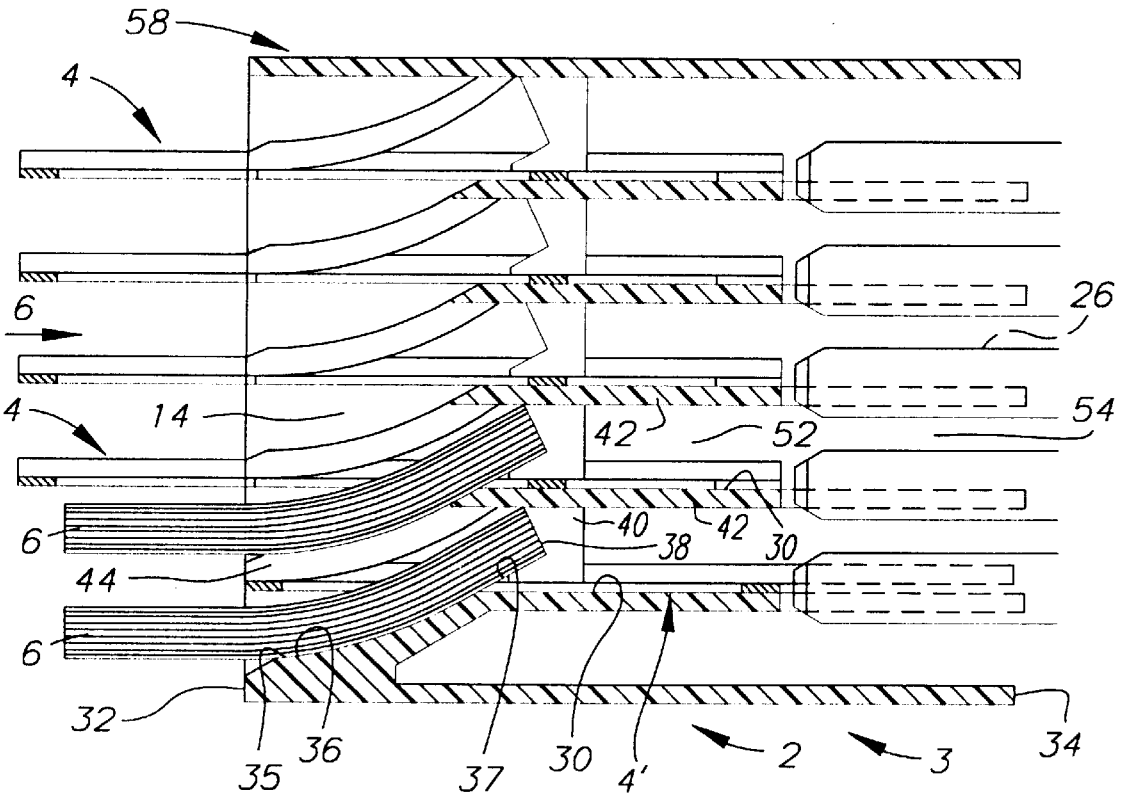
FIG. 1 is a cross-sectional view of an electrical connector with a conducting wire connected thereto, and another conducting wire about to be electrically connected thereto.

Referring first to FIG. 1, an electrical connector 2 is shown comprising an insulative housing 3 and terminals 4 stamped and formed from sheet metal, the connector 2 for connection to insulated conducting wires 6.

Figure 3:
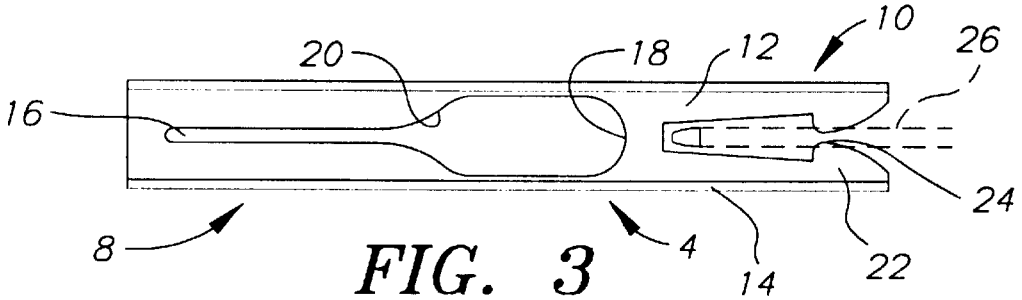
FIGS. 3 and 4 are side and end views of a female terminal insertable into the housing of FIG. 2.
Figure 4:
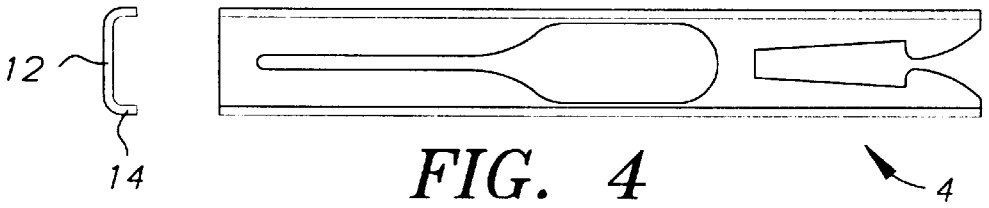

Referring now to FIGS. 3 and 4 the terminal 4 is shown comprising and IDC connection section 8 and a complementary contact mating section 10, a planar base 12 extending between the connection section 8 and contact section 10, and extending perpendicularly from the base 12 along lateral edges thereof are reinforcing walls 14. The IDC connection section 8 comprises an IDC slot of wire terminating slot 16 for making electrical contact to conducting strands of the wire 6, the IDC slot 16 extending into a wider wire receiving slot or aperture 18 via a Y-shaped transition portion 20. The wire receiving and IDC slots 18, 16 respectively are edge-stamped out of the base 12. FIG. 3 shows a receptacle connector having a pair of opposed contact arms 22 forming a fork shape, the contact arms 22 having opposed contact protrusions 24 at a forward end thereof whereby the contacts 22 are also edge-stamped from the base 12. As shown in FIG. 3, a complementary male tab shown in dotted lines is insertable between the contact protrusions 24 for contact therewith. The complementary male tab 26 could also have a IDC connection section 28 similar to the IDC section 8 of the female terminal 4.

Referring now to FIGS. 1, 2, 6, 7 and 8, the housing 3 will be described in detail. The housing 3 comprises a plurality of juxtaposed terminal receiving cavities 30 extending between a rear face 32 and a front face 34 of the connector housing, the terminal receiving cavities being intersected by wire receiving cavities 36 that commence at the rear face 32 and are bent such that they traverse obliquely across the terminal receiving cavity 30 and end at a stop 38 formed by a stop wall 40 projecting orthogonally from a side wall 42 of the wire receiving cavity 30. Adjacent wire receiving cavities 36 are separated by separating walls 44 parallel to the cavities 30, the separating walls 44 split into two by a centrally located gap 46, whereby the plane located centrally between sides 47 of the gap 46 was also the central plane between opposing surfaces 50 of the stop wall 40. The stop wall 40 is however of lesser thickness (i.e. the distance between opposing surfaces 50) than the distance between opposing surfaces 47 of the gap 46 for reasons that will be described hereinafter.

Beyond the stop wall 40 towards the front face 34, there are further cavities 52 contiguous with the terminal receiving cavities 30, and extending into a front cavity 54 for receiving the complementary terminals 26 of a complementary connector therein. The mid-cavities 52 are linked to the wire receiving cavities 36 by cavity portions 56 adjacent either surface 50 of the stop wall 40. Adjacent mid-cavities 52 of a row of cavities 58 are separated by the cavity side walls 42 which also serve to support the terminals 4 in the longitudinal direction. The terminal receiving cavities 30 have L-shaped cavity portions 60 on lateral ends thereof for receiving the lateral walls 14 of the terminals 4 and a small portion of the base 12 for supporting and allowing sliding insertion of the terminals 4 longitudinally into the terminal receiving cavities 30.

Referring to FIG. 1, one of the terminals is shown in the fully inserted position and is numbered 4' in order to distinguish it from the other terminals that are in a preassembly (or wire receiving) position. The fully assembled terminal 4' is shown mated to a complementary tab terminal 26 that is positioned in the front cavity area 54 of the connector.

The gap 47 in the bent guide walls 44 of the housing 3, is provided to allow a mould die to form the stop wall 40 and wire receiving cavities 36, whereby the stop wall 40 is of lesser thickness than the gap 47 (or equal thereto) such that a die being inserted from the front face 34 can interlock with the die projecting through the gap 47 so as to form a forward portion 37 of the wire receiving cavity 36 and the stop wall 40. In the latter forming process, the dies are inserted longitudinally from the rear face and the opposing front face and can be extracted in the same manner once the plastic has been injected into the mould, the gap 47 and cavities 56 on either side of the stop wall 40 being necessary to provide longitudinal access to the front portion 37 of the wire receiving cavities. A rearward portion 35 of the wire receiving cavity 35 is formed by a mould die inserted from the rear face 32.

Connection of one of the wires 6 to it's corresponding terminal 4, is effectuated as follows. Prior to connection, the terminals 4 are in a preassembly position whereby they are partially inserted into respective terminal receiving cavities 30 such that the wire receiving slot 18 is aligned with the wire receiving cavities 36 of the housing 3. The wire 6 can then be inserted longitudinally, adjacent and parallel to the base 12 of the terminal 4 into the rearward portion 35 of the terminal receiving cavity 36. Continued urging of the wire 6 in the longitudinal direction causes the forward end of the wire to follow the bend of the wire receiving cavity 36 and pass through the wire receiving slot 18 of the terminal 4 until the wire abuts the stop 38. In this position, the terminal 4 can then be longitudinally inserted further into the cavity 30 until the fully assembled position is attained as shown by the terminal 4' FIG. 1, whereby the wire 6 is forced past the Y-shaped transition portion 20 and into the IDC slot 16 such that the outer insulation is cut and the inner conducting strands are in electrical contact with the edges of the IDC slot 16. The terminal 4 can be held in the connector housing 3 by any known locking means, for example an interference fit or resilient locking lances.

Due to the relatively thin sheet metal base 12, and the large wire receiving slot 18, there is a need to increase the bending rigidity of the terminal 4, especially for urging thereof into the terminal receiving cavity 30, which is effectuated by providing the lateral walls 14 bent perpendicularly from the base 12.

Figure 5:
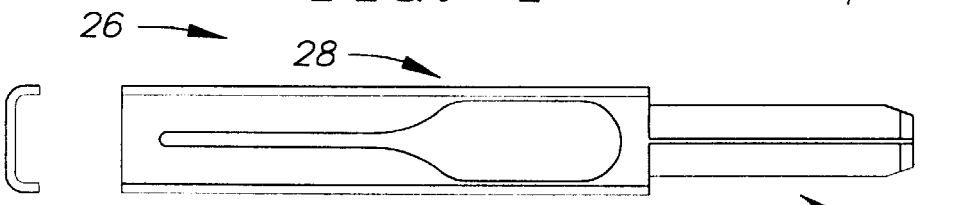
FIG. 5 is a side view of a male tab terminal matable with the female terminal FIGS. 3 and 4, the male terminal also receivable in a connector housing as shown in FIG. 2.
Figure 2:
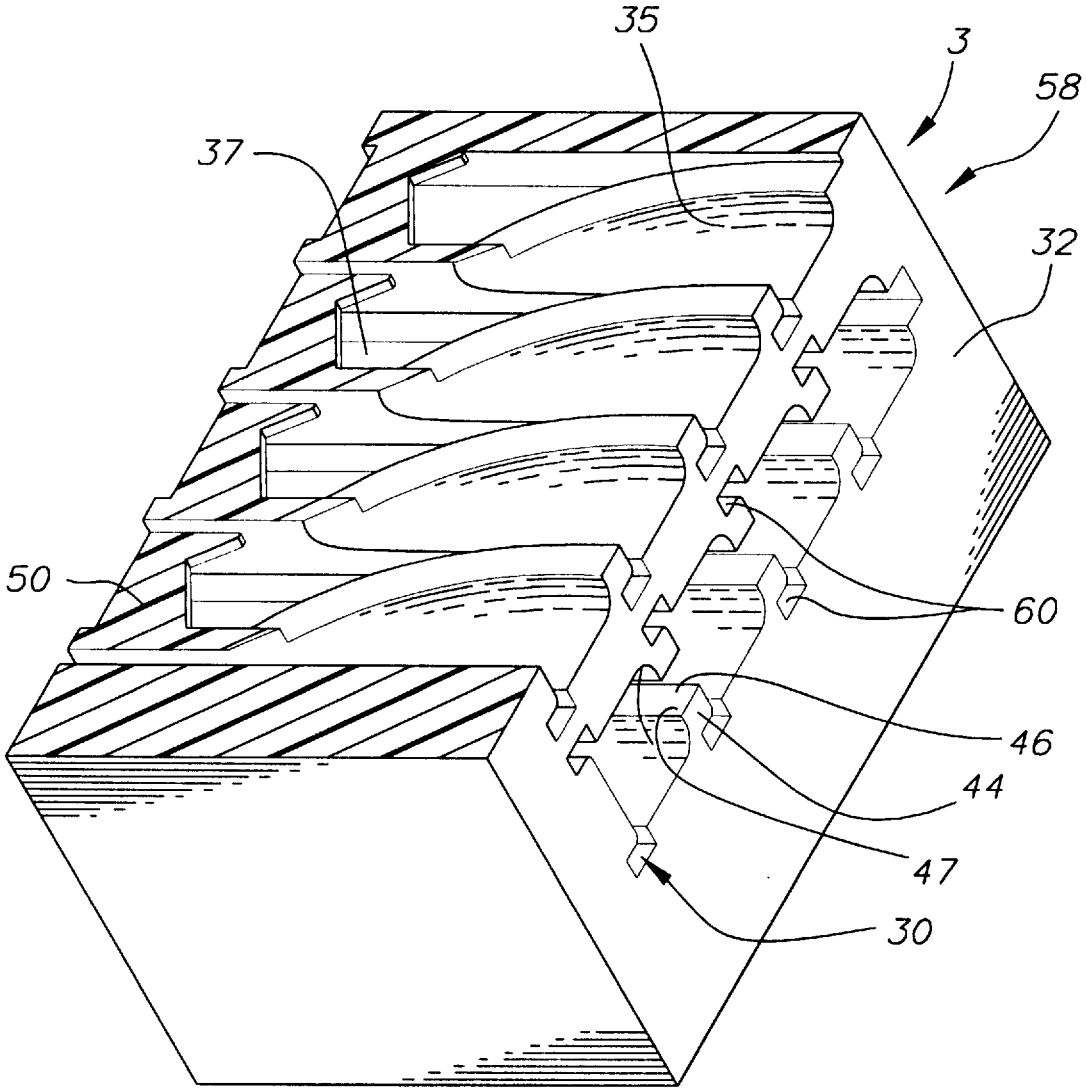
FIG. 2 is a cross-sectional isometric view of part of a connector housing.
Figure 6:
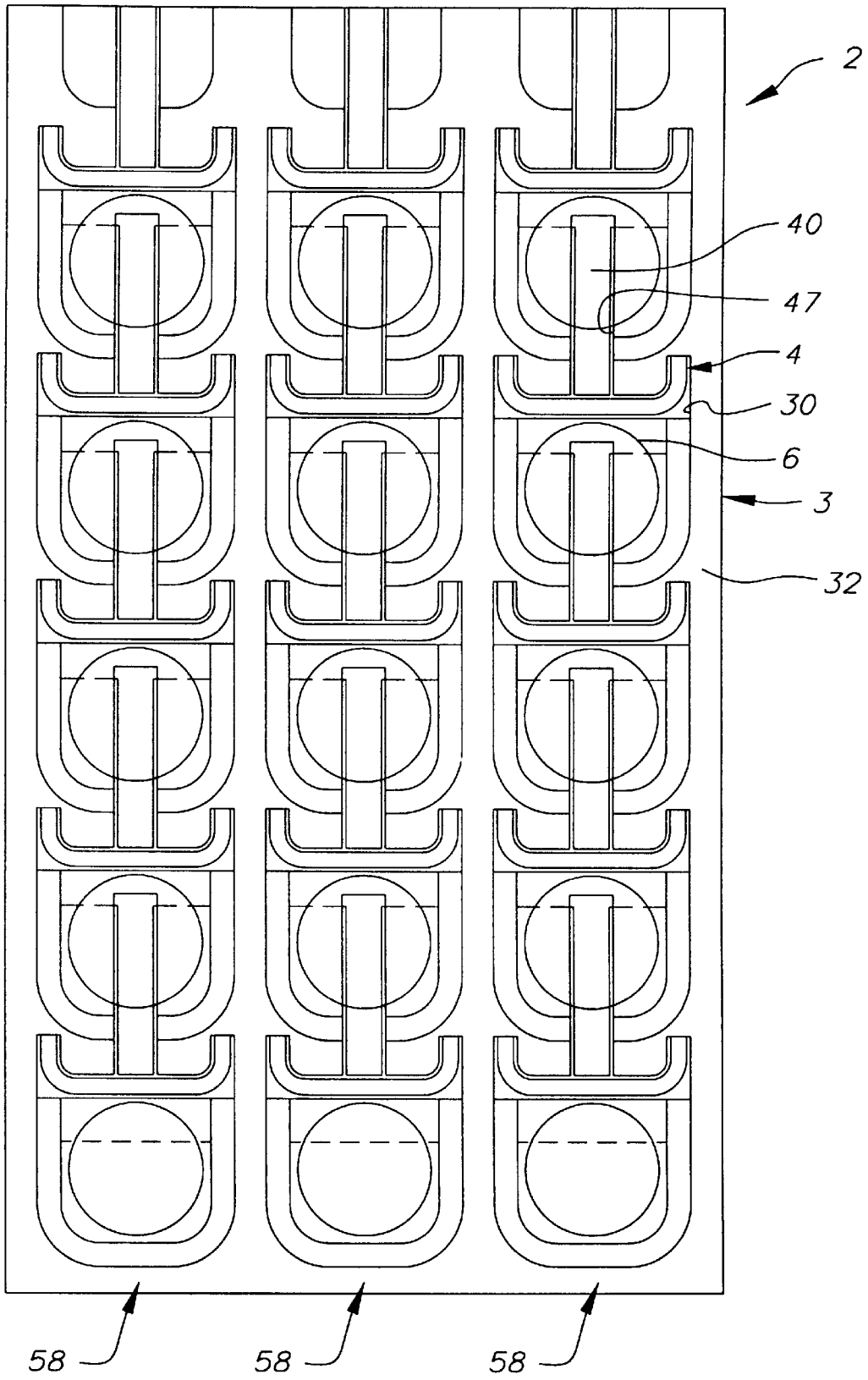
FIG. 6 is a view in the direction of arrow 6 of FIG. 1 showing the rear face of the connector.
Figure 7:
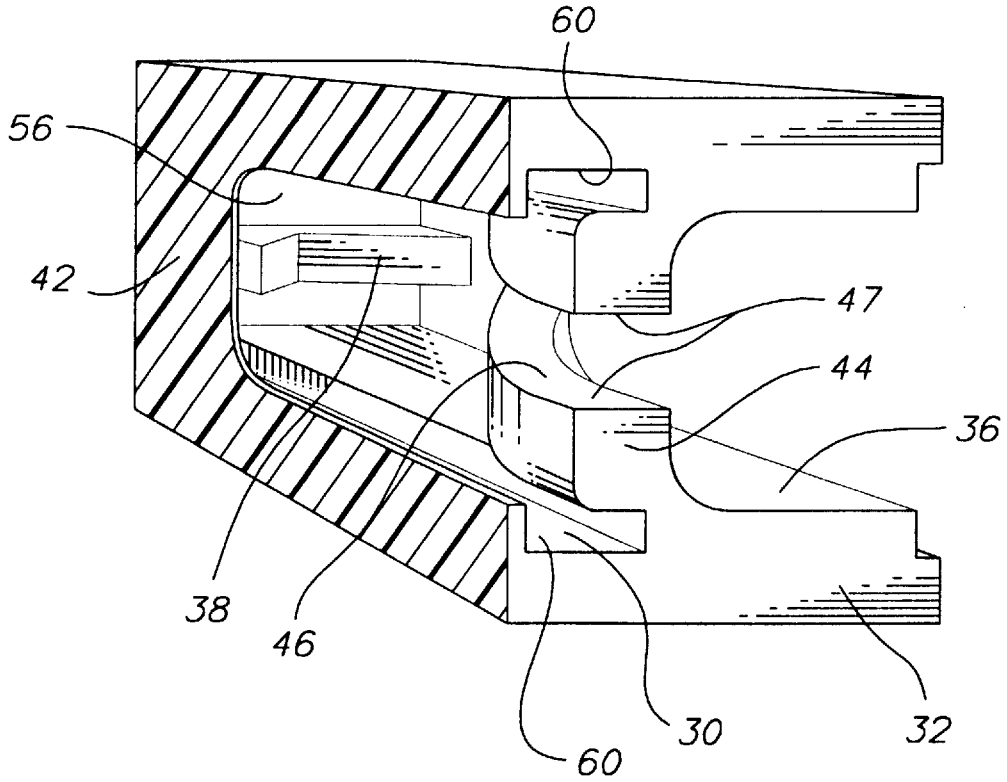
FIGS. 7 and 8 are cross-sectional isometric views of part of the connector housing shown in FIG. 2, showing the terminal receiving and wire receiving cavities.
Figure 8:
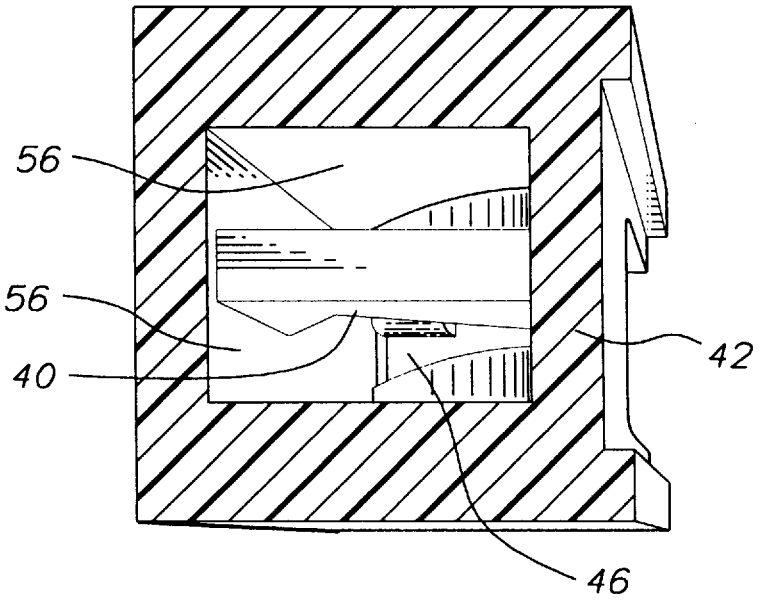

The terminals could have varying complementary terminal contact sections 10 without departing from the spirit of this invention, whereby for example there could also be a male tab terminal as shown in FIG. 5.

Advantageously therefore, due to the longitudinal feeding of the wires 6 into the connector housing 3, in cooperation with the longitudinal disposed IDC terminals 4, a very compact wire-to-wire spacing can be achieved. Additionally, the simple form of the terminals make them cost-effective to produce, whereby their slender shape requires little material and is very compact.

I claim:

1. An electrical connector having an insulative housing and one or more terminals having complementary contact mating sections for mating with complementary contacts an insulation displacement contact IDC sections for connection to substantially longitudinally disposed insulated conducting wires by stuffing the wires in IDC slots of the IDC sections, the terminals received in and held by terminal receiving cavities of the housing extending longitudinally between a rear face and an opposed front face of the connector, wherein the housing has bent wire receiving cavities extending from the rear face and intersection the terminal receiving cavities, the terminals having enlarged wire receiving slots adjacent the IC slots for receiving the wire therethrough when the terminals are in a wire receiving position and the wires are inserted into the wire receiving cavities, each bent wire receiving cavity extending obliquely across the respective terminal wire receiving slot from one side of the terminal to an opposite side of the terminal such that a wire inserted longitudinally into the wire receiving cavity is directed by the housing wire receiving cavity from said one terminal side to said opposite side through the terminal wire receiving slot, whereby the terminals are longitudinally insertable for stuffing the wires into the IDC slots, and adjacent ones of said wire receiving cavities of a row of cavities are separated by bent separating walls, said separating walls having a central gap for allowing access by a mould die to define wire insertion stops during moulding thereof.

2. The connector according to claim 1 wherein the wire insertion stops extend from cavity side walls and have thicknesses equal to or less than the central gaps for allowing access by mould dies inserted from the front face on either side of the stops, in order to mould forward portions of the wire receiving cavities not accessible by mould dies from the rear face.

3. An electrical connector having an insulative housing and one or more terminals having insulation displacement contact IDC sections for connection to substantially longitudinally disposed insulated conducting wires by stuffing the wires in IDC slots of the IDC sections, the terminals received in terminal receiving cavities of the housing extending longitudinally between a rear face and an opposed front face of the connector, wherein the housing has bent wire receiving cavities extending from the rear face and intersecting the terminal receiving cavities, the terminals having enlarged wire receiving slots adjacent the IDC slots for receiving the wire therethrough when the terminals are in a wire receiving position and the wires are inserted into the wire receiving cavities, whereby the terminals are longitudinally insertable for stuffing the wires into the IDC slots, and wherein adjacent wire receiving cavities of a row of cavities are separated by bent separating walls, the separating walls having a central gap for allowing access by a mould die to wire insertion stops during moulding thereof.

4. The connector according to claim 3 wherein the connector housing is a single integral part.

5. The connector according to claim 3 wherein the wire receiving cavities have wire insertion stops for limiting insertion of the wires in their corresponding wire receiving cavities.

6. The connector according to claim 3 wherein the terminals have a substantially planar sheet-metal base out of which the wire receiving slots and IDC slots are edge-stamped.

7. The connector according to claim 6 wherein the terminals have lateral edges bent from the base for increasing the bending rigidity of the terminal.

8. The connector according to claim 7 wherein the base includes an edge-stamped fork-shaped contacting section for making contact to a complementary tab terminal.

9. The connector according to claim 7 wherein the base includes a male tab contacting section for making contact to a complementary female terminal.

10. The connector according to claim 3 wherein the wire insertion stops extend from cavity side walls and have thicknesses equal to or less than the central gaps for allowing access by mould dies inserted from the front face, on either side of the stops, in order to mould forward portions of the wire receiving cavities not accessible by mould dies from the rear face.

11. The connector according to claim 10 wherein the IDC section of the terminal has substantially a C-shaped profile when viewing in the longitudinal direction.

12. An electrical connector comprising:

an insulative housing having at least one terminal receiving cavity extending thereinto from a first face at least toward an opposed second face, and a respective terminal secured in said at least one terminal receiving cavity;

said housing including a wire receiving cavity including a bend therealong and having a portion adjacent said bend in communication with said at least one terminal receiving cavity;

said terminal securable in said housing in a first position and movable along said terminal receiving cavity to a second position;

said terminal including a closed-ended wire receiving aperture and a wire terminating slot extending from said wire receiving aperture, said wire receiving aperture being dimensioned larger than a diameter of a wire to be terminated by said terminal;

said wire receiving aperture of said terminal being aligned with said wire receiving cavity portion when said terminal is in said first position for receipt therethrough of an end portion of a respective said wire upon insertion of said wire into said wire receiving cavity; and said wire end portion being received into said wire terminating slot for termination to said terminal when said terminal is moved to said second position.

13. The connector according to claim 12 wherein said connector housing is a single integral part.

14. A connector according to claim 12 wherein said wire receiving cavity has a wire insertion stop for limiting insertion of said wire upon insertion into said wire receiving cavity.

15. A connector according to claim 12 wherein said wire terminating slot of said terminal has a substantially a C-shaped profile when viewing in the longitudinal direction.

16. A connector according to claim 12 wherein said wire is insertable into said wire receiving cavity by urging said wire in said longitudinal direction adjacent said terminal.

17. A connector according to claim 12 wherein said terminal has a substantially planar sheet-metal base out of which said wire receiving aperture and said wire termination slot are edge-stamped.

18. A connector according to claim 17 wherein said terminal has lateral edges bent from said base for increasing the bending rigidity of the terminal.

19. A connector according to claim 18 wherein said base includes an edge-stamped fork-shaped contacting section for making contact to a complementary tab terminal.

20. A connector according to claim 18 wherein said base includes a male tab contacting section for making contact to a complementary female terminal.

21. A connector according to claim 12 wherein said housing has a plurality of said wire receiving cavities and terminal receiving cavities and said terminals, and adjacent ones of said wire receiving cavities of a row of cavities are separated by bent separating walls, said separating walls having a central gap for allowing access by a mound die to define wire insertion stops during moulding thereof.

22. A connector according to claim 21 wherein said wire insertion stops extend from cavity side walls and have thicknesses equal to or less than said central gaps for allowing access by mould dies inserted from a second face of said housing, on either side of said stops, in order to mould forward positions of said wire receiving cavities not accessible by mould dies from said first face.

* * * * *